US006082091A

United States Patent [19]

Schröder

[11] Patent Number: 6,082,091

[45] Date of Patent: Jul. 4, 2000

[54] OPEN END ROTOR SPINNING DEVICE

[75] Inventor: Hans Josef Schröder, Monchengladback, Germany

[73] Assignee: W. Schlafhrost AG & Co., Moenchengladbach, Germany

[21] Appl. No.: 09/257,325

[22] Filed: Feb. 25, 1999

[30] Foreign Application Priority Data

Feb. 27, 1998 [DE] Germany ..... 198 08 244

[51] Int. Cl.[7] ..... D01H 4/00

[52] U.S. Cl. ..... 57/407; 57/406

[58] Field of Search ..... 57/406, 407, 411, 57/413

[56] References Cited

U.S. PATENT DOCUMENTS

| | | | |
|---|---|---|---|
| 4,069,655 | 1/1978 | Stahlecker et al. | 57/407 |
| 4,112,659 | 9/1978 | Stahlecker et al. | 57/407 |
| 5,337,552 | 8/1994 | Schuller et al. | 57/406 |
| 5,433,068 | 7/1995 | Stahlecker | 57/407 |

FOREIGN PATENT DOCUMENTS

| | | |
|---|---|---|
| 3247411 | 6/1984 | Germany . |
| 3527943 | 2/1987 | Germany . |
| 3636182 | 4/1988 | Germany . |
| 4304088 | 8/1994 | Germany . |
| 4323213 | 1/1995 | Germany . |
| 19524837 | 1/1997 | Germany . |

*Primary Examiner*—William Stryjewski

*Attorney, Agent, or Firm*—Kennedy Covington Lobdell & Hickman, LLP

[57] ABSTRACT

An open-end spinning device (1) with a spinning rotor (17) which is mounted with its rotor shaft (8) in the V-slots of a support-disk bearing (5) and whose spinning cup (17) rotates at a high speed in a rotor housing (6) which is open to the front and can be loaded by suction. The rotor housing (6) can be closed by a pivotably mounted cover element (10) which comprises a sliver opening device and is arranged so that it can be disengaged if required. The cover element (10) can be attached to the spinning box (2) via a mounting device (20) comprising fork-shaped connecting brackets (22) and pivot bolts (30) rotatably seated in the housing wall (38) of the open-end spinning device (1). If required, the cover element (10) can be easily removed after securing means (32), which are easily accessible, have been loosened.

6 Claims, 3 Drawing Sheets

OPEN END ROTOR SPINNING DEVICE

BACKGROUND OF THE INVENTION

The present invention relates generally to open-end rotor spinning devices and more particularly to open-end spinning devices comprising a rotor housing having a forward opening, a spinning rotor defining a spinning cup supported for high speed rotation in the rotor housing, and a cover element for closing the forward opening of the housing.

Such open-end rotor spinning devices are known from various publications. By way of example, German Patent Publication DE 36 36 182 C2 describes rotor spinning devices which are fixed by their spinning box frames to the machine frame of an OE spinning machine. Each spinning box frame has a rotor housing which can be loaded by suction and in which rotates the rotor cup of a spinning rotor supported on support disks. The rotor housing, which is open to the front, is closed by a cover element during the spinning process.

In this known rotor spinning device the pivotably supported cover element also has a sliver opening device which comprises, as is customary, a sliver drawing-in cylinder, an opening roller or cylinder rotating in an opening-roller housing as well as a one-piece yarn guide conduit extending between the opening roller and the spinning rotor.

The spinning box can be opened in order to carry out maintenance work or other servicing. In this instance, the cover element is unlocked and folded down about a swivel pin located in the area of the rear of the spinning box. During the swiveling of the cover element both the drive whorl of the opening roller as well as the worm gear arranged on the end of the sliver drawing-in cylinder come out of engagement with the associated drive means, whereby the rotatable elements of the sliver opening device slow to a standstill. At the same time the braking of the spinning rotor is initiated via a lever linkage.

The position of the swivel pin of the cover element is particularly disadvantageous in this type of spinning box. The swivel pin, which is arranged relatively far behind the rotor cup, results in unfavorable geometric conditions and thereby in certain problems especially during the pivoting in of the conduit plate extension which supports the sliver guide conduit for opening into the rotor cup.

The above-described disadvantage is avoided in open-end rotor spinning devices like those known, e.g., from German Patent Publications DE 43 23 213 A1 or DE 43 04 088 A1.

German Patent Publication DE 43 23 213 A1 describes by way of example a rotor spinning device whose cover element is mounted so that it can swivel about a swivel pin aligned orthogonally to the rotor axis at a location vertically below the rotor opening. The swivel pin about which the cover element can be pivoted is preferably formed by short bolts which are arranged in arms or brackets forwardly projecting from the wall of the spinning box frame and over which extend fastening lugs with slot-like recesses facing rearwardly from the cover element. The bolts are fixed in these recesses by securing means which can be unscrewed.

Thus, the pivotable cover element can be removed as an entire unit after loosening of the securing means. The arrangement of the swivel pin approximately vertically below the rotor opening results in a very small vertical offset to be taken into account during the pivoting in of the conduit plate extension and enables the mouth area of the sliver guide conduit to be placed very close to the sliver sliding wall of the rotor, which has a very positive effect on the spinning result. However, this known device has the disadvantage that the securing means arranged in the area of the swivel pin of the cover element can hardly be accessed or accessed only with very great difficulty in the case of spinning devices built into the textile machine.

The rotor spinning device according to German Patent Publication DE 43 04 088 A1 describes a rotor spinning device with a removable cover element which is detachably held via a fork-like holding fixture on a correspondingly formed support fixed to the wall of the spinning box frame. The cover element rests in the area of the drive shaft for the sliver drawing-in cylinder which extends the length of the machine and, thus, the cover element can be taken off transversely to its swivel pin without any securing elements or the like having to be loosened beforehand. However, the danger in such an embodiment that the folded-up cover element may come loose inadvertently from its support can not be entirely excluded.

SUMMARY OF THE INVENTION

In view of the known open-end rotor spinning devices of the above-described type, the present invention has the basic object of improving such rotor spinning devices.

The invention solves this problem in an open-end rotor spinning device basically comprising a spinning box frame, a rotor housing mounted on the spinning box frame and having a forward opening, a spinning rotor defining a spinning cup supported for high speed rotation in the rotor housing, and a cover element for closing the forward opening of the rotor housing. In accordance with the present invention, a novel device is provided for mounting the cover element on the spinning box frame for selective pivotable opening and closing movement relative to the forward opening of the rotor housing and for selective removal from the spinning box frame. The mounting device basically comprises pivot bolts rotatably seated in the spinning box frame, fork-shaped connecting brackets on the cover element mateable with the pivot bolts, and securing devices for affixing together the pivot bolts and the connecting brackets. The securing devices are disengagable for disconnection of the connecting brackets and the pivot bolts and are accessibly disposed for selective disengagement.

The easily releasable connection of the cover element thusly achieved in accordance with the present invention has the advantage, in particular in connection with the easily accessible securing device, that on the one hand it is assured that the cover element is securely connected with the spinning box frame both during the spinning process and in the opened position, but that, on the other hand, if required, for example if adjustment and cleaning work is to be performed on the units of a sliver opening device integrated into the cover element, the simple and problem-free removal of the cover element is possible at any time. The reinstallation of the cover element following any such operation also entails no problems. No time-consuming adjustment work or the like is required in such case.

Preferably, the securing device is designed as threaded bolts in an advantageous embodiment, which bolts are disposed to be easily accessible from the front of the open-end spinning device. Thus, the bolts, e.g. hexagon socket screws arranged in bores in a base plate of the cover element, can be loosened without problems by means of an appropriate tool from the service platform extending between the textile machines. Thereafter, the cover element can easily be pulled off toward the front from the pivot bolts remaining in the spinning device.

The pivot bolts are preferably embodied in several component parts and respectively comprise a seating element for connecting the cover element, and a cover screw for fixing in place a sliding bearing, which can be placed into the housing wall of the spinning box. In a preferred embodiment the seating elements respectively have a polygonal shoulder with parallel extending seating faces on which the connecting brackets of the cover element can be fixed in place interlockingly and fixed against relative rotation via a fork-shaped connecting opening.

The seating element furthermore has a dynamically balanced sliding bearing receptacle portion, which is received into a bore in the housing wall of the spinning box and is surrounded by a two-piece sliding bearing, preferably made from a plastic material.

The above described embodiment of a releasable, easily accessible fastening of the cover element on the spinning box frame with connecting brackets embodied in a fork-shape, which can be fixed in place on special pivot bolts, as well as the seating of these pivot bolts in the housing wall of the spinning box by means of sliding bearings, not only results in a sturdy and dependable fastening of the cover element, which can be easily released when required, but the type of seating represented is also very cost-effective.

Further details, features and advantages of the invention are explained in and will be understood from the following description of an exemplary embodiment with reference to the accompanying drawings.

DESCRIPTION OF THE PREFERRED EMBODIMENT

Figure 1:
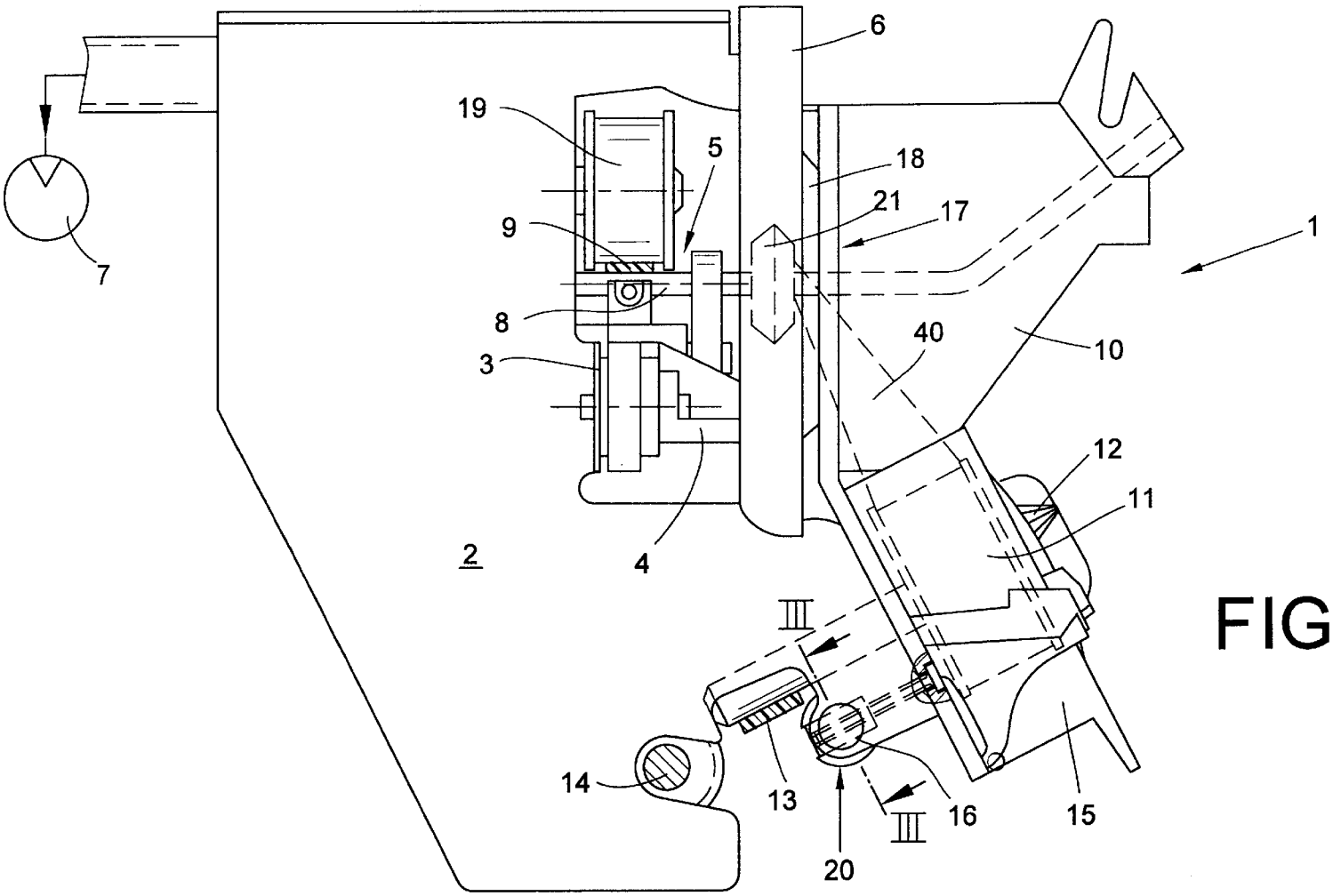
FIG. 1 is a side elevational view of an open-end spinning device having a pivotably mounted, readily removable cover element in accordance with the present invention, shown in closed operating position.
Figure 2:
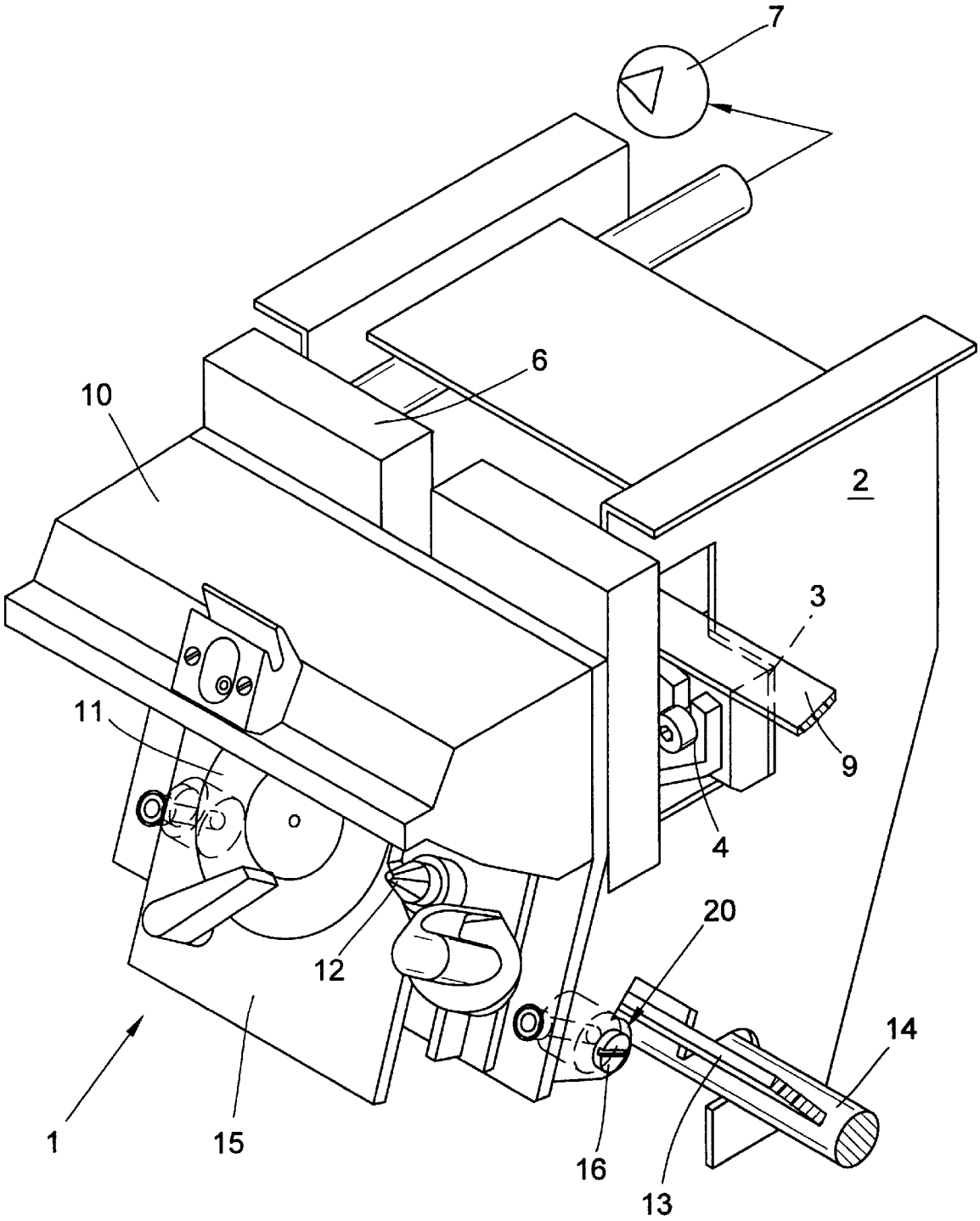
FIG. 2 is a perspective view of the open-end spinning device of FIG. 1.

Referring now to the accompanying drawings and initially to FIGS. 1 and 2, an open-end spinning device 1 according to the present invention is shown in FIG. 1 in an operating state and in FIG. 2 in an opened state. As is known, the open-end spinning device 1 is a component of an open-end spinning machine (not shown in more detail) which comprises a plurality of these open-end spinning devices 1 aligned adjacent to each other in series. Each open-end spinning device 1 is fastened by a spinning box frame 2 on the machine frame (not shown) of the open-end spinning machine.

A bearing block 4, which carries support-disk bearing 5, is fastened to the spinning box frame 2 via fastening brackets 3. Spinning rotor 17 is supported with its rotor shaft 8 in the bearing nips of support-disk bearing 5 and is driven tangentially by belt 9 extending the length of the machine and is placed on rotor shaft 8 by pressure roller 19, such that the spinning cup 21 of the rotor rotates at a high speed in rotor housing 6. The belt 9 extends the length of the machine and is held in peripheral contact with rotor shaft 8 by pressure roller 19.

Rotor housing 6 is connected to vacuum source 7 and defines a forwardly facing opening which is normally closed by cover element 10 during the spinning operation. Specifically, cover element 10 has a so-called conduit plate and a lip seal 18 in the conduit plate by which the cover element 10 rests in an airtight manner on rotor housing 6. As is known, cover element 10 is mounted so that it can pivot in a limited manner about swivel pin 16 and cover element 10 carries a sliver opening device comprising opening roller 11 rotating in opening-roller housing 15 and sliver drawing-in cylinder 12. Opening roller 11 is driven by tangential belt 13 which extends the length of the machine and sliver drawing-in cylinder 12 is preferably driven by a worm gear or drive shaft 14 which similarly extends the length of the machine. Moreover, opening roller 11 is connected, as is customary, to spinning rotor 17 via a yarn guide conduit indicated in broken lines in FIGS. 1 and 2.

Cover element 10 is removably fastened to spinning box frame 2 and can be readily mounted or dismounted as required via the mounting device 20 of the present invention, which is equipped with a securing means 32 disposed to always be easily accessible.

Figure 3:
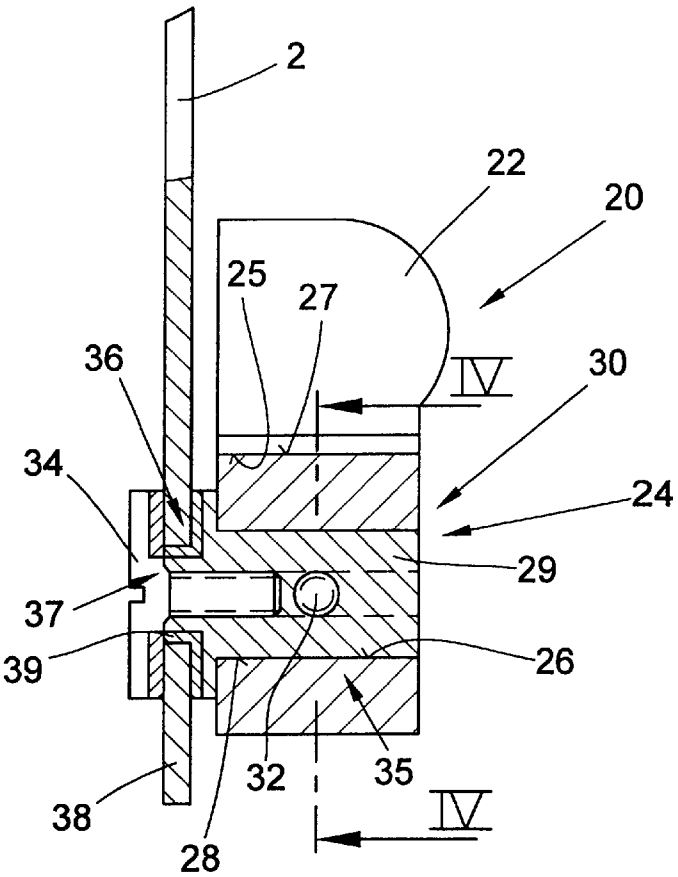
FIG. 3 is a cross-sectional view of the mounting device for the cover element in accordance with the present invention, taken along the line III—III in FIG. 1.
Figure 4:
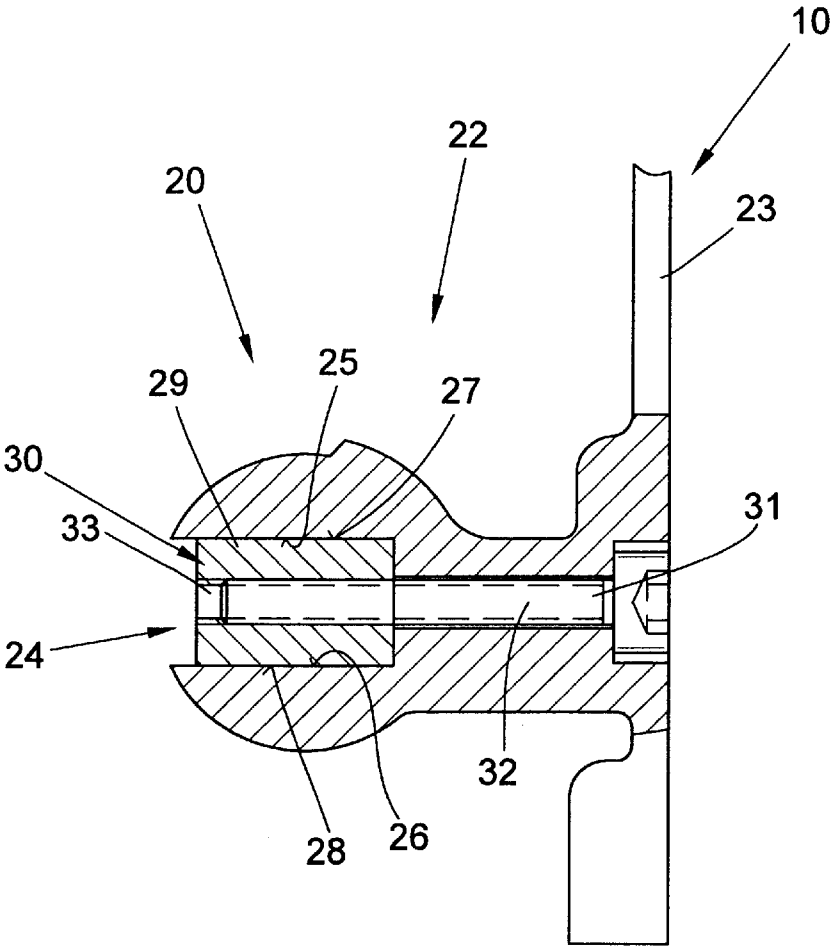
FIG. 4 is another cross-sectional view of the mounting device for the cover element in accordance with the present invention, taken along the line IV—IV in FIG. 3.

The mounting device 20 is shown in different cross-sectional views in FIGS. 3 and 4, respectively, and includes connecting brackets 22 formed in the shape of a fork, particularly visible in FIG. 4, as well as pivot bolts 30, which are rotatably fixed in place in wall elements 38 of the spinning box frame 2. The fork-shaped connecting brackets 22 are formed in one piece unitarily with a base plate 23 of the cover element 10 and each connecting bracket 22 defines a receiving opening 24 with parallel extending bearing faces 25, 26.

The bearing faces 25, 26 of each connecting bracket 22 are configured to mate with corresponding bearing faces 27, 28 on a seating element 29 of a corresponding one of the pivot bolts 30. The base plate 23 of the cover element 10 has through-bores 31 each of which opens into the receiving opening 24 within a corresponding respective one of the connecting brackets 22. With the cover element 10 installed, the bores 31 are aligned with threaded bores 33 formed through the seating elements 29 of the pivot bolts 30. Securing means 32, preferably hexagonal socket screws, are threadedly engaged in the aligned bores 31, 33, to fix the connecting brackets 22 on the pivot bolts 30.

As can be seen from FIG. 3, each of the pivot bolts 30 are formed of two component parts, namely a seating element 29 and a covering screw 34, which is threadedly fixed in place in the seating element 29.

Each of the connecting brackets 22 has a polygonal shoulder 35 as well as a dynamically balanced sliding bearing receptacle portion 36. In the installed state, the sliding bearing receptacle portion 36, on which a two-part sliding bearing 39 is positioned, extends through a bore 37 in the wall 38 of the spinning box frame 2 and is fixed in place in this bore 37 by the covering screw 34 of the pivot bolt 30.

Thus, the pivot bolts 30 can be fixed in place in a rotatably movable manner on the walls 38 of the spinning box frame 2, and have bearing faces 27, 28 in the area of their polygonal shoulder 35 for an easily releasable connection within the connecting brackets 22 of the cover element 10, whereby the cover element 10 is dependably fixed in place in its connected position by means of easily accessible securing means 32.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An open-end spinning device comprising a spinning box frame, a rotor housing mounted on the spinning box frame and having a forward opening, a spinning rotor defining a spinning cup supported for high speed rotation in the rotor housing, a cover element for closing the forward opening of the rotor housing, and a device for mounting the cover element on the spinning box frame for selective pivotable opening and closing movement relative to the forward opening of the rotor housing and for selective removal from the spinning box frame, the mounting device comprising pivot bolts rotatably seated in the spinning box frame, fork-shaped connecting brackets on the cover element mateable with the pivot bolts, and securing devices for affixing together the pivot bolts and the connecting brackets, the securing devices being disengagable for disconnection of the connecting brackets and the pivot bolts and being accessibly disposed for selective disengagement.

2. The open-end spinning device in accordance with claim 1, wherein the securing devices comprise threaded bolts disposed for accessibility from a front side of the rotor housing.

3. The open-end spinning device in accordance with claim 1, wherein each of the pivot bolts comprises multiple components including a seating element for connection with one connecting bracket of the cover element and a covering screw for affixing the seating element to the spinning box frame.

4. The open-end spinning device in accordance with claim 3, wherein the spinning box frame defines mounting bores and each seating element includes a dynamically balanced sliding bearing receptacle for receipt within one mounting bore and a polygonal shoulder for connection with one connecting bracket.

5. The open-end spinning device in accordance with claim 4, wherein each connecting bracket defines a receiving opening and the polygonal shoulder of each seating element has parallel bearing faces for mated releasable receipt within the receiving opening of one connecting bracket.

6. The open-end spinning device in accordance with claim 4, wherein the mounting device further comprises a two-piece sliding bearing disposed on the sliding bearing receptacle of each seating element.

* * * * *